US007059488B2

(12) United States Patent
Myers

(10) Patent No.: US 7,059,488 B2
(45) Date of Patent: Jun. 13, 2006

(54) ISO FITTINGS FOR COMPOSITE STRUCTURES

(75) Inventor: Gerald D. Myers, Fairbanks, AK (US)

(73) Assignee: Centec Corporation, Fairbanks, AK (US)

( * ) Notice: Subject to any disclaimer, the term of this patent is extended or adjusted under 35 U.S.C. 154(b) by 148 days.

(21) Appl. No.: 10/610,010

(22) Filed: Jun. 30, 2003

(65) Prior Publication Data

US 2004/0262305 A1 Dec. 30, 2004

(51) Int. Cl.
*B65D 88/02* (2006.01)

(52) U.S. Cl. ..... 220/1.5; 220/23.4; 220/4.03; 220/629; 220/628

(58) Field of Classification Search ..... None
See application file for complete search history.

(56) References Cited

U.S. PATENT DOCUMENTS

| | | | | |
|---|---|---|---|---|
| 3,620,277 | A | | 11/1971 | Tummarello |
| 3,861,106 | A | | 1/1975 | Erhart |
| 3,932,946 | A | | 1/1976 | Johnson |
| 4,173,856 | A | | 11/1979 | Fricker |
| 4,231,709 | A | | 11/1980 | Corsetti |
| 4,695,184 | A | * | 9/1987 | Robishaw et al. ..... 403/410 |
| 4,722,155 | A | | 2/1988 | Ericsson |
| 4,743,485 | A | | 5/1988 | Ting |
| 4,833,841 | A | | 5/1989 | Ellington, III |
| 4,940,252 | A | | 7/1990 | Seib |
| 5,186,330 | A | | 2/1993 | McClure |
| 5,193,325 | A | | 3/1993 | Allison |
| 5,257,440 | A | | 11/1993 | Bardou et al. |
| 5,285,604 | A | | 2/1994 | Carlin |
| 5,979,684 | A | | 11/1999 | Ohnishi et al. |
| 6,012,598 | A | | 1/2000 | Antoniou |
| 6,023,891 | A | | 2/2000 | Robertson et al. |
| 6,338,513 | B1 | | 1/2002 | Williams |
| 6,345,472 | B1 | | 2/2002 | Taylor |

* cited by examiner

*Primary Examiner*—Stephen Castellano
(74) *Attorney, Agent, or Firm*—Jenkens & Gilchrist

(57) ABSTRACT

An apparatus and method are disclosed for removably attaching an ISO corner fitting to a composite material shipping container. The apparatus and method of the invention comprises a post that is anchored in the composite material frame of the container. The ISO corner fitting is then attached to the post using a connector assembly that may be engaged and disengaged as needed to attach and detach the ISO corner fitting from the post. The post has a plurality of grooves formed thereon that help hold the post in the composite material of the shipping container. The grooves transfer any tension or compression loads that are applied to the ISO corner fitting directly to the shipping container.

24 Claims, 8 Drawing Sheets

ISO FITTINGS FOR COMPOSITE STRUCTURES

BACKGROUND OF THE INVENTION

1. Technical Field

This invention relates generally to the use of ISO corner fittings in composite material structures, and particularly to an apparatus and method for facilitating maintenance of such ISO corner fittings in composite material structures.

2. Description of the Related Art

An ISO (International Standards Organization) container is a freight or shipping container that complies with relevant ISO container standards, such as ISO 668 (5th edition) and ISO 1496-3 (4th edition). For examples of ISO shipping containers, see U.S. Pat. Nos. 4,231,709; 4,940,252; and 6,012,598, which are hereby incorporated by reference.

Heretofore, manufacturers of ISO shipping containers have used metal framework with steel or aluminum sheathed panels made of composition board or other materials attached to the framework by bolts, rivets or welding. Corner fittings are then attached, in accordance with ISO standards, to each corner of the shipping container. The ISO corner fittings are used to secure cables and other components to the shipping containers during loading and unloading of the containers, as well as to secure the containers to one another and to the transport vehicle. Consequently, the attachment between the corner fitting and the shipping container must be able to support the entire weight of the shipping container plus any cargo therein. For containers that are transported by air lift, the ISO corner fittings must further be able to support the dynamic load imposed during the air lift, which is typically about three times that of the static load.

Due to the tremendous loads routinely placed on the ISO corner fittings, these components sustain a significant amount of wear and tear damage. Use of damaged and/or worn ISO corner fittings presents a safety risk that can have disastrous consequences. For example, in applications that require the shipping container to be lifted or hoisted in the air, a damaged and/or worn ISO corner fitting can result in the container being dropped. Therefore, it is absolutely vital that maintenance be performed regularly and frequently on the ISO corner fittings to repair or replace damaged and/or worn fittings. Regular maintenance and repair helps keep the ISO corner fittings in good operating condition and can extend the service life of the much more expensive and harder to replace shipping containers.

A primary consideration in determining how often maintenance and repair is performed is the attachability and detachability of the ISO corner fittings. If the ISO corner fittings can be easily detached from and reattached to the shipping containers, it will take less time, effort, and costs to perform maintenance and repair. As a result, the ISO corner fittings are more likely to have frequent maintenance and repair and be kept in good operating condition. On the other hand, if the ISO corner fittings are difficult to remove and reattach, maintenance and repair is less likely to be performed very frequently and the ISO corner fittings are more likely to be in poor operating condition.

A number of techniques exists for attaching an ISO corner fitting to a shipping container. FIG. 1 illustrates an example of a prior part attachment technique. As can be seen, an ISO corner fitting 100 is formed in a rectangular box shape with openings or eyelets 102 formed on three of the surfaces thereof. The ISO corner fitting 100 is usually oriented so that the eyelet surfaces are exposed when the corner fitting is mounted on the shipping container. Various attachments can then be attached to the eyelets 102 to facilitate lifting, moving, loading, lockdown, and off-loading of the containers. A steel, cast iron or aluminum extension 104 is welded to the bottom (or top) surface of the corner fitting 100, which is itself also made of steel or cast iron. The extension 104 has a number of holes 106 formed therein through which bolts or rivets may be driven to attach the ISO corner fitting 100 to the shipping container. In some cases, a steel or cast iron flange 108 may also be welded to the inner or unexposed side surfaces of the ISO corner fitting 100. The flange 108 also has a number of holes 110 formed therein through which bolts or rivets may be driven to strengthen the attachment between the corner fitting 100 and the shipping container.

The above attachment technique works reasonably well if one is using the metal frame and panel type shipping containers. The problem with using the metal frame and panel type shipping containers is they are very heavy. For example, a standard 20' long container constructed to meet ISO size requirements (typically 8' wide×8' high) weighs on the order of 4,000 to 5,000 lbs. The heavier weight of these containers limits the maximum cargo weight, or payload, that can be transported in such a container. The heavier weight also increases the transportation costs in terms of reduced gas mileage and excess wear and tear damage on the transport equipment.

Metal frame and panel shipping containers have another drawback in that a difference in the thermal expansion characteristics of the various materials used in the construction of the containers can cause the metal framework to expand or contract at different rates than the panels. The difference in thermal expansion characteristics is particularly significant in extreme temperature environments where the joints between the panels and the metal frame can become stressed or cracked, permitting moisture and water to enter into the joint. Also, for panels that have a metal surface over a nonmetallic core, the metal surface tends to expand and contract at a different rate than the underlying nonmetallic core, resulting in possible delamination of the panel.

Corrosion is another problem for metal-framed shipping containers, especially in marine and industrial environments. Moisture can cause the metal frame and panels to rust, possibly causing separation at the various joints thereof. Certain chemicals can cause corrosion of the metal frame and panels, thereby compromising the structural integrity of the shipping container.

Shipping containers that are made of composite material, on the other hand, have been shown to be far superior to the metal-framed shipping containers in the above respects. For purposes of this description, the term "composite material" refers to any type of reinforced polymer or epoxy material. The reinforcing material may be a woven or non-woven fiber material such as glass fibers or carbon fibers that are then coated with a polymer or an epoxy. Other high strength materials such as Kevlar® may also be used to is reinforce the composite material. Such composite materials are well known and may be available from, for example, Creative Protrusion, Inc. of Alum Bank, Pa., Advanced Composite Materials, Inc. of Eureka Springs, Ark., and Zoltek Corporation of St. Louis, Mo. Shipping containers made of such composite materials have been shown to have higher load bearing capacity than their metal-framed counterparts, yet are lighter in weight. This lighter weight will increase the amount of cargo that can be carried in the shipping containers, while at the same time reduce the cost of transporting the containers. Composite material structures have also been shown to be more resistant to corrosion and rust, making the containers more suitable for use in marine and other hostile environments. In addition, the composite material renders the structures virtually invisible to detection by radar, an extremely desirable quality for applications that require stealth (e.g., military or intelligence gathering applications). By the same token, the composite material does not impede reception or transmission of radio waves and, therefore, will not prohibit or interfere with radio communication to and from the structure.

Presently, however, there is no way to quickly and easily attach and detach an ISO corner fitting to and from a shipping container made of composite material. The ability to quickly and easily attach and detach the ISO corner fitting, as mentioned above, is of key importance in facilitating maintenance and repair of the ISO corner fittings. Existing attachment techniques, such as the one shown in FIG. 1, would not work well with composite material shipping containers. The bolts or rivets holding the ISO corner fitting in place would likely rip right through the lighter weight composite material when any significant load is applied. Even assuming these techniques could be used with composite material shipping containers, maintenance and repair would still be very difficult to perform. For example, the extension 104 and the flange 108 would have to be cut through to remove the ISO fitting. The ISO fitting would then have to be welded back on to the extension 104 and the flange 108 to reattach it. Welding, however, is highly ill-advised once the composite material is in place, as the heat from a blow torch may severely damage the composite material. Alternatively, each of the bolts or rivets holding the ISO corner fitting in place could be completely removed and the entire assembly be detached. The same process would have to be performed in reverse in order to reattach the ISO corner fitting. This entire process, however, would not only be tedious, time consuming, impractical, and costly, but would also discourage frequent performance of maintenance and repair.

Accordingly, in order to take advantage of the many benefits of composite material shipping containers without compromising safety and reliability, what is needed is a way to easily attach and detach an ISO corner fitting to the composite material shipping container without welding, cutting, or taking apart the ISO corner fitting assembly.

SUMMARY OF THE INVENTION

The present invention is directed to an apparatus and method for removably attaching an ISO corner fitting to a composite material shipping container. The apparatus and method of the invention comprises a post that is anchored in the composite material frame of the shipping container. The ISO corner fitting is then attached to the post using a connector assembly that may be engaged and disengaged as needed to attach and detach the ISO corner fitting from the post. The post has a plurality of grooves formed thereon that help hold the post in the composite material of the shipping container. The grooves transfer any tension or compression loads that are applied to the ISO corner fitting directly to the shipping container.

In some embodiments, at least one side of the ground post is substantially flat relative to the other sides to help withstand any torsional or rotational load applied to the ISO corner fitting.

In some embodiments, each connector assembly is oriented in a direction so as to prevent the ISO corner fittings from being inadvertently detached from the shipping container during transportation thereof.

BRIEF DESCRIPTION OF THE DRAWINGS

A more complete understanding of the invention may be had by reference to the accompanying detailed description when taken in conjunction with the following drawings, wherein.

DETAILED DESCRIPTION OF THE INVENTION

Figure 1:
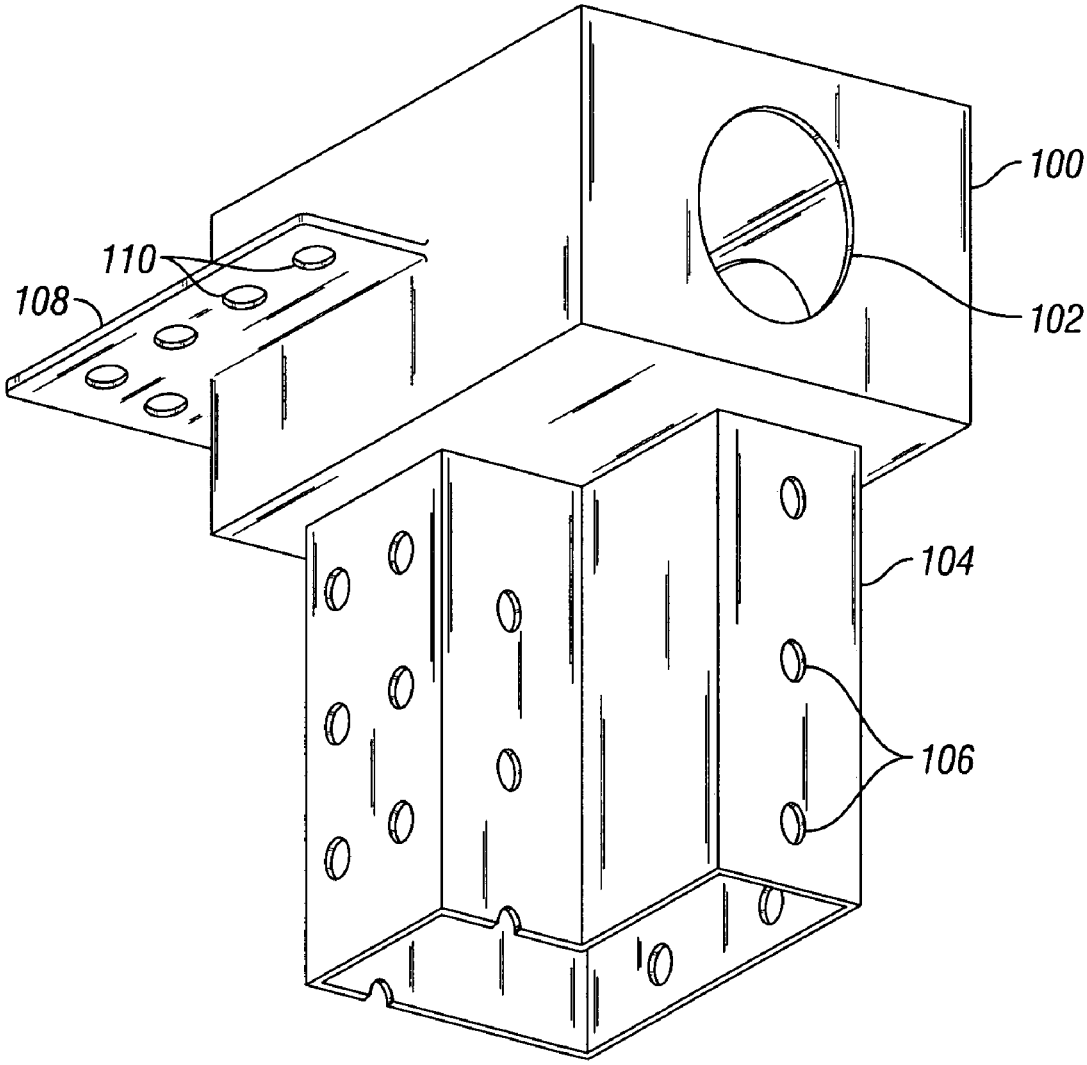
FIG. 1 (Prior Art)
FIG. 1 illustrates a prior art means for attaching an ISO corner fitting to shipping container.

Following is a detailed description of exemplary embodiments of the invention wherein reference numerals for the same and similar elements are carried forward throughout the various figures. It should be noted that the figures are provided for illustrative purposes only and should not be taken as drawn to any particular scale.

As mentioned previously, it is of vital importance for safety reasons to keep the ISO corner fittings in good operating condition, lest one of them should give way, for example, while the shipping container is hanging in midair. Keeping the ISO corner fittings in good operating condition requires that maintenance and repair be performed regularly and frequently on the ISO corner fittings. A primary consideration in determining how often maintenance and repair is performed is the detachability of the ISO corner fittings. If the ISO corner fittings can be easily detached from and reattached to the shipping containers, it will take less time, effort, and costs to perform maintenance and repair and, as a result, the ISO corner fittings are more likely to be kept in good operating condition. On the other hand, if the ISO corner fittings are difficult to remove and reattach, such as in the case where bolts, rivets or welds are used, maintenance and repair is less likely to be performed very frequently.

The present invention solves the above problems by providing a way to attach an ISO corner fitting to a shipping container without the use of bolts, rivets or welds. The invention is especially useful for attaching ISO corner fittings to shipping containers made of composite material where bolts, rivets and welds are particularly problematic. In accordance with embodiments of the invention, a post is anchored in the composite material of the shipping container. The anchored post serves as an attachment point to allow exterior components, such as ISO corner fitting, to be releasably attached to the composite material shipping container. A connector assembly that can be selectively engaged and disengaged as needed is then used to attach the ISO corner fitting to the anchored post. The connector assembly allows the ISO corner fitting to be easily attached to and detached from the anchored post in the shipping container. In this way, maintenance and repair may be performed more easily by simply engaging and releasing the connector assembly to attach and remove the ISO corner fitting.

Figure 2:
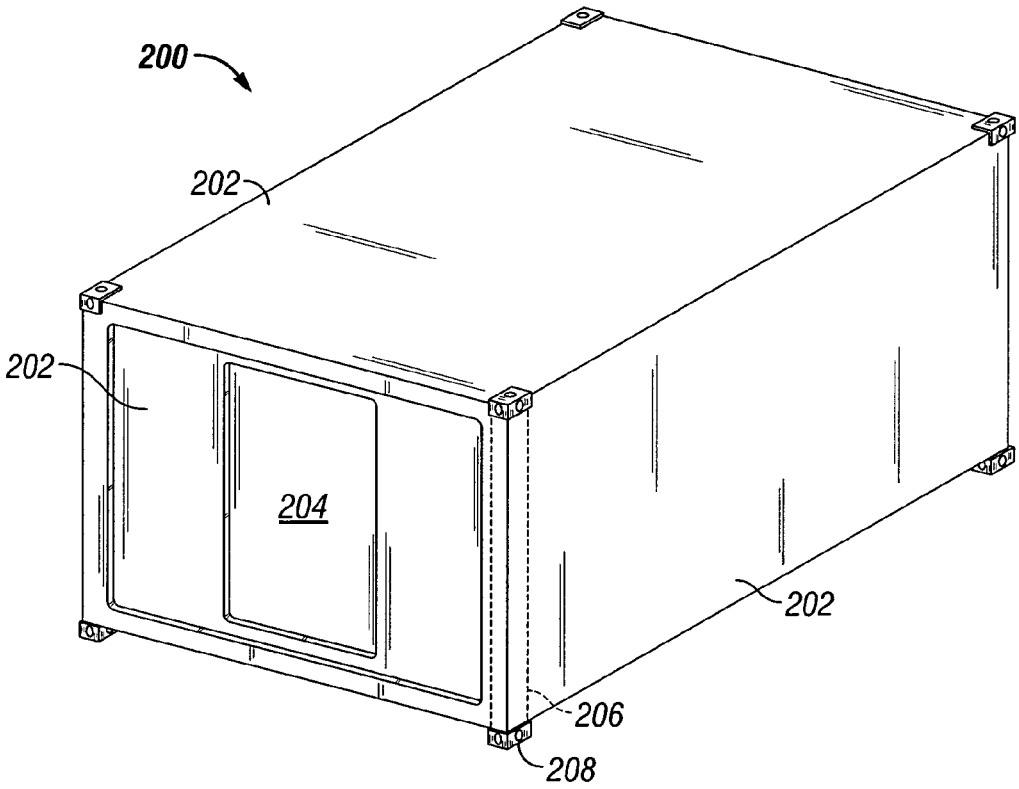
FIG. 2 illustrates a composite material shipping container having ISO corner fittings attached thereto according to embodiments of the invention.

Referring now to FIG. 2, an example of a composite material shipping container 200 according to embodiments of the invention can be seen. The composite material shipping container 200, as the term implies, is made entirely or almost entirely of a composite material such as fiberglass or carbon fiber reinforced polymer or epoxy. Such a composite material is commonly used in car fenders, boat hulls, and other sturdy, yet light weight applications. The structure of the composite material shipping container 200 may be a unitary structure having a monocoque construction, i.e., it is a structure in which the skin carries all or a major part of the stresses imposed on the structure, or it may be a traditional frame type structure where the frames are made of composite material. Load and force induced stresses are distributed on the shipping container 200 along three axes at right angles with respect to each other along the side, end, roof, and floor panels (indicated generally at 202). For example, a force applied to an upper corner of the shipping container 200 is distributed along the side wall, end wall, and roof panels 202 of the shipping container 200. An opening or entrance 204 may be formed in one of the end walls 202. The wall, roof, and floor panels 202, when assembled, form a substantially rectangular shape shipping container of standard size and dimensions.

The wall, roof, and floor panels 202, in some embodiments, (are assembled by adhering or gluing layers of composite material around an inner core of foam or possibly a honeycomb type structure may be used. The outer layers may be made of the same composite material, or they may be different composite materials, depending on the material properties needed for a particular application. Most of the panels 202 are generally flat, two-dimensional panels, but some may be curved or angled at some predetermined angle if needed.

The wall, roof, and floor panels 202 are reinforced by composite material columns at the four vertical corner edges of the shipping container 200, one of which is indicated by the dashes lines at 206. A post (see FIGS. 3–4) is then anchored or buried in the composite material columns 206 at the top and bottom ends of each column 206. ISO corner fittings 208 are thereafter attached to the posts anchored in the columns 206. There are two corner fittings 208 per column 206 for a total of eight corner fittings per shipping container 200.

Figure 3:
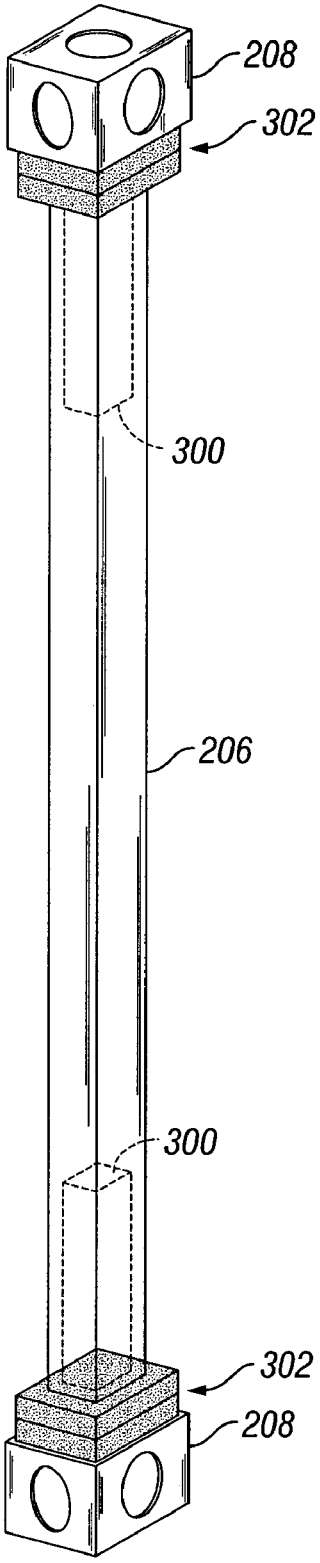
FIG. 3 illustrates the composite material column having ISO corner fittings attached thereto Via connector assemblies according to embodiments of the invention.

FIG. 3 shows the composite material column 206 in more detail according to embodiments of the invention. As can be seen, a post 300 is anchored in the column 206 at each end thereof. The dimensions of the post 300 depend on the expected structural load and material used, and may be, for example, 4×4×12 inches and preferably made of metal such as steel, cast-iron, or the like. The unburied end of the post 300; i.e., the end that is exposed relative to the column 206, is connected to a connector assembly 302. The connector assembly 302 may be connected to the post 300, for example, by welding one side/half to the exposed end of the post 300. The welding should be performed prior to anchoring the post 300 in the column 206 in order to avoid damaging the composite material, although it is possible to perform the welding afterward in some cases if done carefully. The ISO corner fitting 208 is then connected (e.g., also by welding) to the other side/half of the connector assembly 302. In some embodiments, it is also possible to screw or bolt the ISO corner fitting 208 to the other side/half of the connector assembly 302. The ISO corner fitting 208 may then be attached to and detached from the post 300 by engaging and disengaging the connector assembly 302 as needed.

To anchor the post 300 in the column 206, strips of the polymer or epoxy coated fiberglass or carbon fiber fabric material of the column 206 are wrapped around the entire post 300 except for the exposed end during the formation of the column 206. When the polymer or epoxy dries and hardens, the post 300 naturally becomes fastened or wedged in the column 206. Adhesives may also be used in some cases to help anchor the post 300 in the column 206. In some embodiments, the anchoring of the post 300 in the column 206 is essentially permanent, i.e., the post. 300 is not replaced or otherwise removed from the column 206 during the life of the container.

Figure 4A:
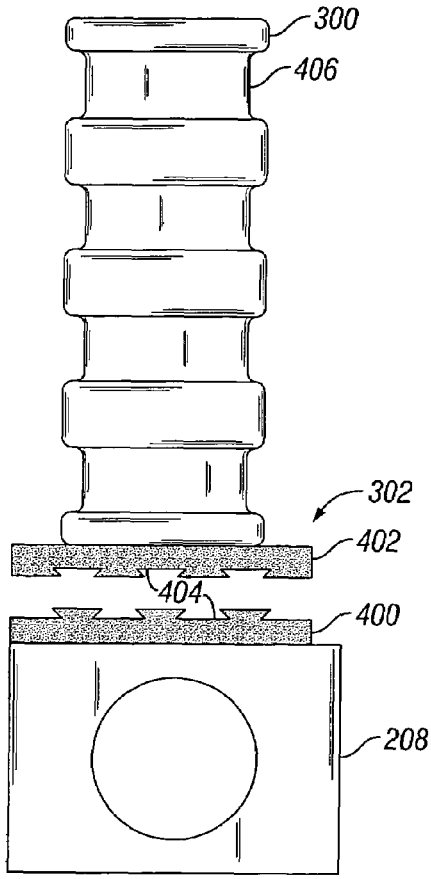
FIGS. 4A–4C illustrates front and side views of the ISO corner fitting and the connector assembly according to embodiments of the invention.

The connector assembly 302 may be any type of connector or joint that can be selectively engaged and disengaged. Preferably, the connector assembly 302 is one that is relatively simple and easy to operate, has few or no moving parts, yet provides a reliable and secure attachment for the ISO corner fitting. An example of such a connector assembly is a dovetail joint. Dovetail joints are well known to those having ordinary skill in this art and therefore will be described only briefly here. Referring now to FIG. 4A, the connector assembly 302 includes a first component 400 and a second component 402, which are the first half and second half of a dovetail joint, respectively. As can be seen, each one of the components 400 and 402 has guides or slots 404 formed on opposing faces thereof for receiving the other one of the components 400 and 402. The post 300 is connected (e.g., welded) to the first component 400 on the other face thereof, i.e., the face that does not have the guides or slots 404. Likewise, the ISO corner fitting 208 is connected (e.g., welded, screwed, bolted) to the second component 402 on the other face thereof. To engage the two components 400 and 402 of the connector assembly 302, simply align the guides or slots 404 of the two components 400 and 402 and slide the two components 400 and 402 toward one another.

An advantage of using a dovetail joint as the connector assembly 302 is that the positions of the ISO corner fittings may be adjusted, by adjusting the two halves of the dovetail joint, to adjust the distance between adjacent fittings. This adjustability is important because ISO standards require that the ISO fittings be located exactly a certain distance from each other. The two components 400 and 402 may then be locked together, for example, by inserting a screw through them.

In some embodiments, the post 300 has a plurality of circumferential grooves 406 formed thereon to help hold the post 300 in the column 206 (see FIG. 3) of the shipping container. Specifically, when the fiberglass or carbon fiber reinforced composite material of the column 206 fills in the grooves 406 and dries and hardens, the post 300 will be prevented from moving into or out of the column 206. The grooves also serve to transfer any tension and/or compression loads from the ISO corner fitting 208 directly to the column 206 of the shipping container.

Figure 4B:
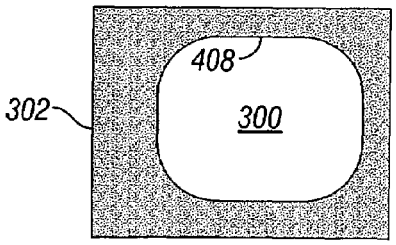
Figure 4C:
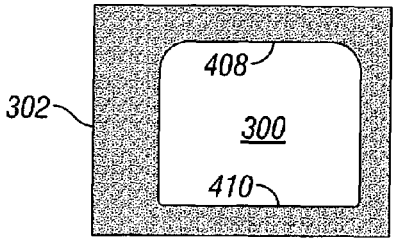

FIG. 4B illustrates a top view of the post 300 and the connector assembly 302 according to some embodiments of the invention. As can be seen, the post 300 has a somewhat rectangular cross-sectional profile with sides (one of which is indicated at 408) that have substantially rounded corners. In many applications, such a cross-sectional profile is sufficient for the particular needs of the application. However, rounded corners may not be suitable for applications where there is a significant amount of torsional load applied to the ISO corner fitting 208. Therefore, in some embodiments, the post 300 may have a cross-section with at least one side 410 that is substantially flatter than the other sides 408, as can be seen in FIG. 4C. The substantially flat side 410 provides rotational resistance for the post 300 to help it withstand any torsional loads that may be applied to the ISO fitting 208.

Figure 5A:
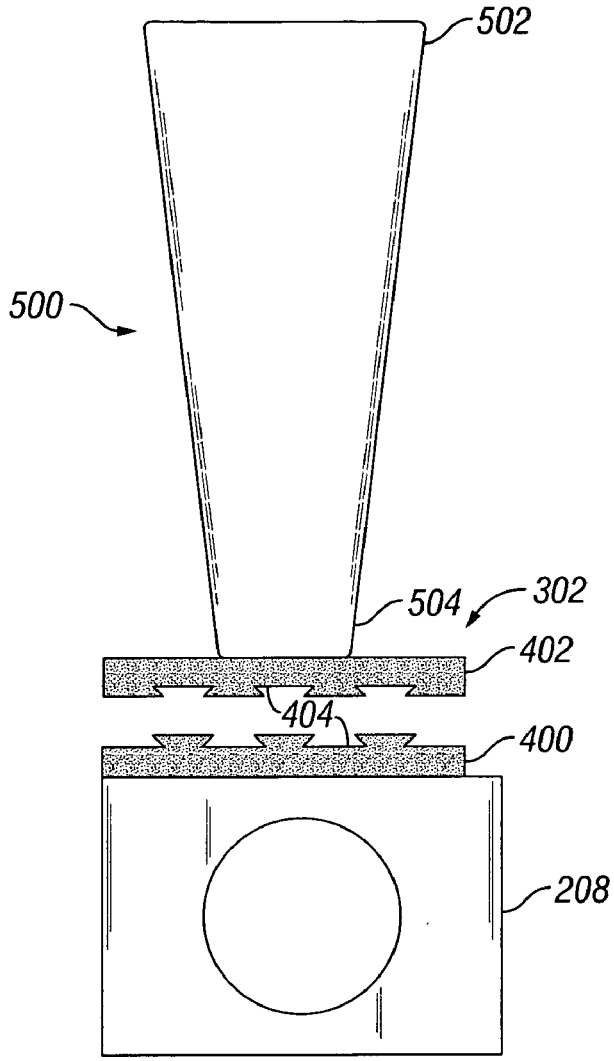
FIGS. 5A–5C illustrates front and side views of the ISO corner fitting and the connector assembly according to embodiments of the invention.
Figure 5B:
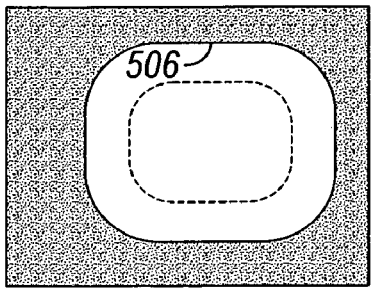
Figure 5C:
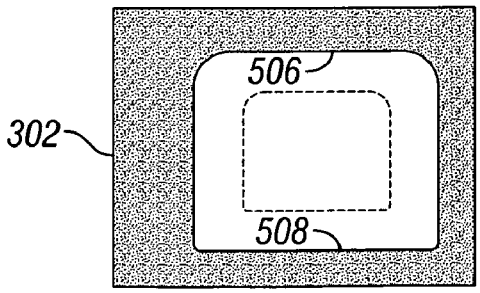

FIG. 5A illustrates another post 500 according to embodiments of the invention. The post 500 is essentially similar to the post 300 except that it is tapered. As can be seen, the embedded or buried end 502 has a larger circumference than the end 504 that is attached to the connector 302. Such a tapered design helps anchor the post 500 in the column 206 and may be used in addition to or instead of the grooves and adhesives described earlier. FIG. 5B illustrates a top view of the post 500 in one embodiment of the invention where the small end 504 is shown as a dotted line and the sides 506 have somewhat rounded corners. FIG. 5C illustrates a top view of the post 500 in another embodiment of the invention where one of the sides 508 is substantially flatter than the other sides 506 in order to help resist any torsional load that might be applied to the post 500.

Note that in the embodiments of FIGS. 4A–4C and 5A–5C, the guides or slots 404 in the connector assembly, 302' run substantially perpendicular to either the length or the width of the ISO corner fitting 208 and, hence, to the length or width of the shipping container. This orientation of the guides or slots 404 can result in the first and second components 400 and 402 inadvertently sliding apart and disengaging during transportation of the shipping containers because the shipping containers tend to be lined up parallel or perpendicular to the direction of travel. As the transport vehicle starts and stops, the shipping containers naturally shift back and forth along the direction of travel.

Figure 6:
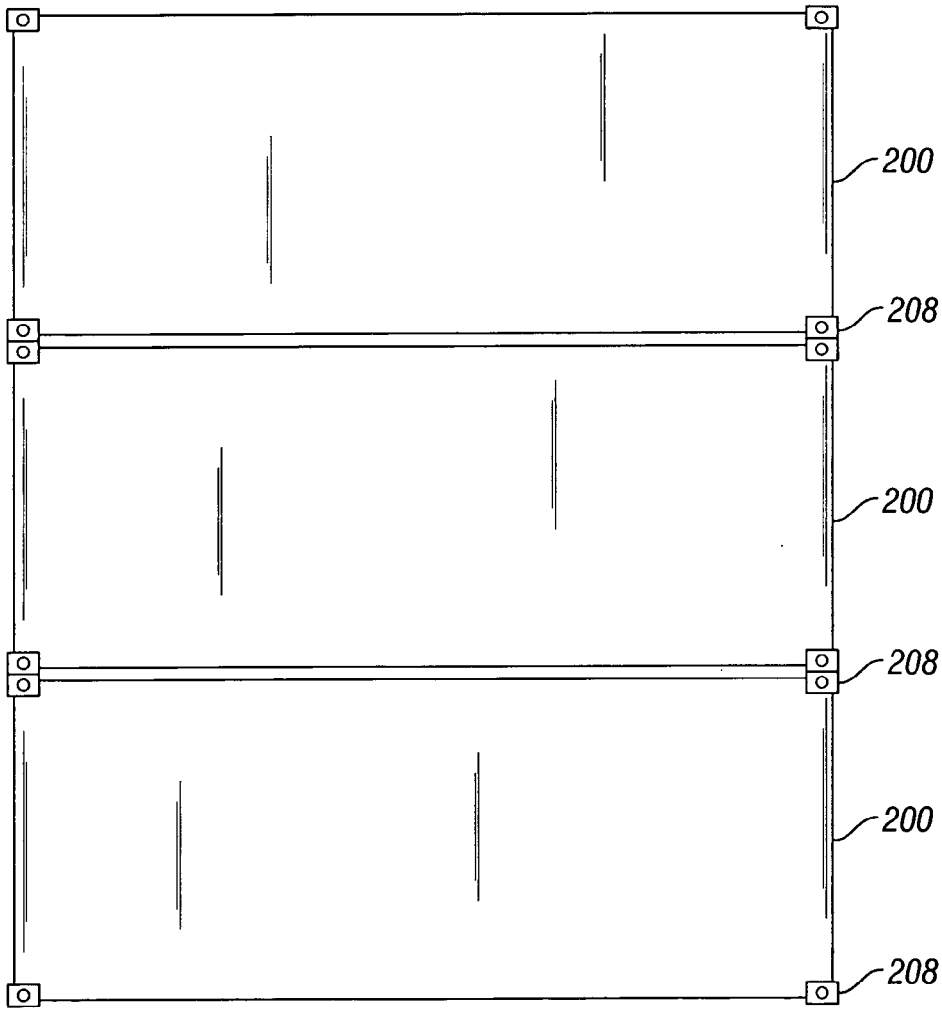
FIG. 6 illustrates several composite material shipping container stacked on top of each other by their ISO corner fittings according to embodiments of the invention.

The above situation is illustrated in FIG. 6, where several composite material shipping containers 200 are stacked on top of each other by their ISO corner fittings 208. Shipping containers 200 have been known to be stacked up to nine containers high. Usually, the ISO corner fittings 208 of adjacent shipping containers are tied together or otherwise secured to one another to prevent the containers from falling off. During transportation, the shipping containers 200 tend to shift either along their lengths (left and right) or along their widths (into and out of the figure). Therefore, to prevent the first and second components 400 and 402 from inadvertently sliding apart and disengaging, in some embodiments, the two components 400 and 402 of the connector assembly 302 may be fastened together, for example, by inserting one or more screws or bolts (not expressly shown) through the two components.

Figure 7:
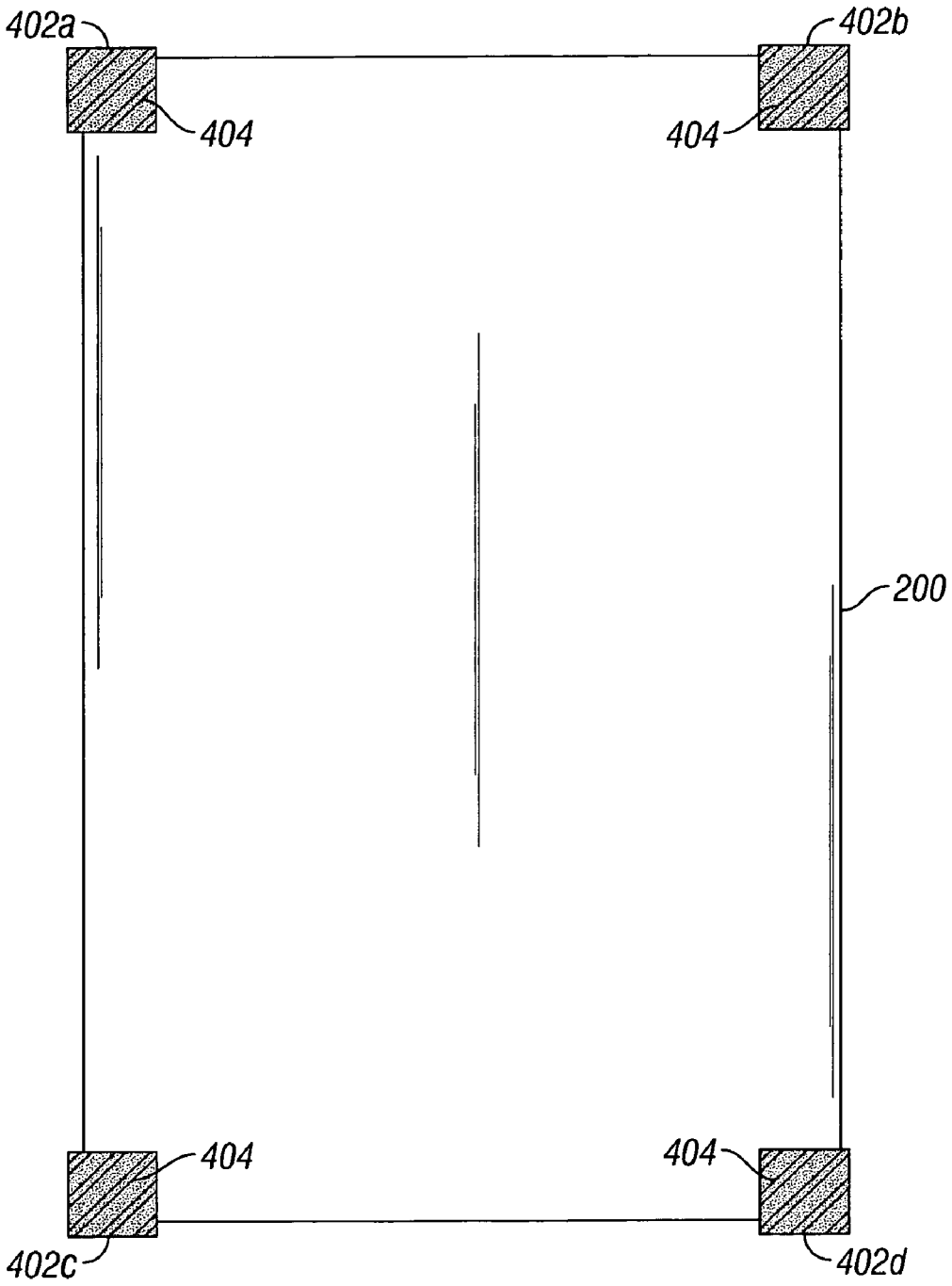
FIG. 7 illustrates an exemplary orientation of the connector assemblies according to embodiments of the invention.

In some embodiments, instead of or in addition to the set screws or bolts, the guides or slots 404 of the connector assembly 302 may all be oriented at an angle relative to the length and width of the shipping container 200 to prevent the first and second components 400 and 402 from inadvertently sliding apart. In FIG. 7, for example, the second component (labeled 402*a–d*) of each of the four connector assemblies have guides or slots 404 that are all oriented at about 45 degrees off of an axis running parallel to the length of the shipping container 200. In this way, forces that are either parallel or perpendicular to the length of the shipping container will not be able disengage the connector assemblies 302.

Figure 8:
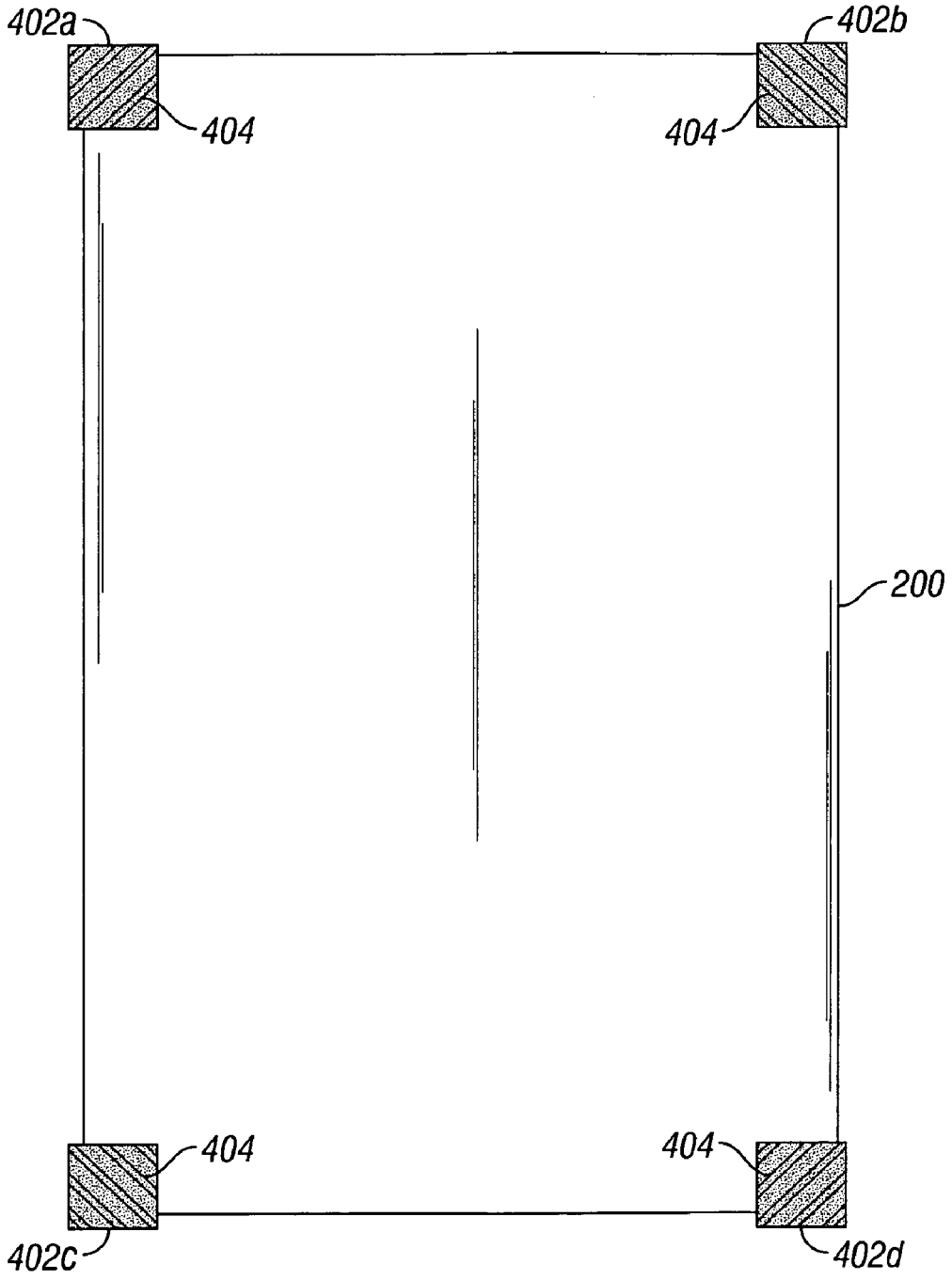
FIG. 8 illustrates another exemplary orientation of the connector assemblies according to embodiments of the invention.

In some embodiments, not all connector assemblies 302 have guides or slots 404 that are oriented in the same direction. In FIG. 8, for example, the guides or slots 404 of each connector assembly (only the second components 402*a–d* are shown) are all oriented at about 45 degrees off of an axis running parallel to the length of the shipping container 200. However, only connector assemblies located diagonally from each other have guides or slots 404 that are oriented in the same direction. Adjacent connector assemblies have guides or slots 404 that are oriented at right angles to each other. In this way, forces exerted on the shipping container 200 that happen to be aligned with the orientation of one set of guides or slots 404 will not be correctly aligned with the orientation of the other guides or slots 404. As a result, none of the connector assemblies can be disengaged regardless of the direction of the forces acting on the shipping container. The only way to disengage the connector assemblies is to disengage each connector assembly one at a time.

While the invention has been described with respect to a number of specific embodiments, those skilled in the art will recognize that the innovative concepts described in the present application can be modified and varied over a wide range of applications. For example, the invention may be used to attach sailboat masts to sailboats, windmill vanes to windmills, and other similar applications. In these applications, the post may be embedded in the composite material hull of the sailboat or the rotor of the windmill, and the mast or vanes may be attached to the post by a releasable connector assembly. In general, the invention may be used in any application where attachment of a component using rivets, bolts or welds is particularly problematic. Accordingly, the scope of patented subject matter should not be limited to any of the specific exemplary teachings discussed, but is instead defined by the following claims.

What is claimed is:

1. In a shipping container having corner fittings attached thereto for use in lifting and hoisting the shipping container, the shipping container having columns located at each vertical corner thereof extending from a top to a bottom of the shipping container for providing structural support for the shipping container, the improvements comprising:

a post partially embedded in the composite material column at each end thereof such that one end of the post remains exposed relative to the composite material column; and a connector assembly having a first component connected to a corner fitting and a second component connected to the post, wherein the corner fitting may be attached to and detached from the post for maintenance and repair by engaging and disengaging the first component and the second component of the connector assembly.

2. The improvements according to claim 1, wherein at least one side of the post is substantially flatter than the other sides of the post.

3. The improvements according to claim 1, wherein the connector assembly is a dovetail joint.

4. The improvements according to claim 2, wherein the dovetail joint has guides that are oriented at an angle off of an axis running parallel to a length of the composite material shipping container.

5. The improvements according to claim 3, wherein adjacent dovetail joints have guides that are oriented at right angles to each other.

6. The apparatus according to claim 1, wherein the composite material is a pultruded material including fiberglass and carbon fiber reinforced materials.

7. The improvements according to claim 1, wherein the post has a plurality of grooves formed thereon for holding the post in the composite material column.

8. The improvement according to claim 1, wherein the post is tapered in order to hold the post in the composite material column.

9. A composite material shipping container, comprising:

a plurality of composite material panels capable of being assembled together to form walls, a roof, and a floor for the composite material shipping container;

a composite material frame having columns located at each vertical corner of the shipping container for providing structural support for the walls, roof, and floor of the composite material shipping container;

a post partially embedded in each column at each end thereof such that one end of the post remains exposed relative to the column;

a connector assembly having a first component and a second component, the second component connected to the exposed end of the post and configured to selectively engage and disengage with the first component; and a corner fitting mounted on each corner of the composite material shipping container, the corner fitting connected to the first component of the connector assembly such that the corner fitting may be attached to and detached from the post by engaging and disengaging the first component and the second component of the connector assembly.

10. The shipping container according to claim 9, wherein the corner fittings comply with ISO requirements for corner fittings and the shipping container complies with ISO requirements for shipping containers.

11. The shipping container according to claim 9, wherein multiple shipping containers may be stacked on top of each other by their corner fittings.

12. The shipping container according to claim 9, wherein at least one side of the post is substantially flatter than the other sides of the post.

13. The shipping container according to claim 9, wherein the connector assembly is a dovetail joint.

14. The shipping container according to claim 13, wherein the dovetail joint has guides that are oriented at an angle off of an axis running parallel to a length of the composite material shipping center.

15. The shipping container according to claim 13, wherein adjacent dovetail joints have guides that are oriented at right angles to each other.

16. The shipping container according to claim 9, wherein the composite material is a pultruded material including fiberglass and carbon fiber reinforced materials.

17. The shipping container according to claim 9, wherein the post has a plurality of grooves formed thereon for holding the post in the column.

18. The shipping container according to claim 9, wherein the post is tapered in order to hold the post in the column.

19. An apparatus for facilitating maintenance and repair of corner fittings in a composite material shipping container comprising:

a composite material column located at each vertical corner of the composite material shipping container extending from a top to a bottom of the composite material shipping container for providing structural support for the composite material shipping container;

a post partially embedded in the composite material column at each end thereof such that one end of the post remains exposed relative to the composite material column, the post having at least one side that is substantially flatter than the other sides of the post; and a dovetail joint having a first component connected to a corner fitting and a second component connected to the post, wherein the corner fitting may be attached to and detached from the post for maintenance and repair by engaging and disengaging the first component and the second component of the dovetail joint.

20. The apparatus according to claim 19, wherein the dovetail joint has guides that are oriented at an angle off of an axis running parallel to a length of the composite material shipping container.

21. The apparatus according to claim 19, wherein adjacent dovetail joints have guides that are oriented at right angles to each other.

22. The apparatus according to claim 19, wherein the composite material is a pultruded material including fiberglass and carbon fiber reinforced materials.

23. The apparatus according to claim 19, wherein the post has a plurality of grooves formed thereon for holding the post in the composite material structure.

24. The apparatus according to claim 19, wherein the post is tapered in order to hold the post in the composite material structure.

* * * * *